US009196263B2

(12) United States Patent
Romsdorfer

(10) Patent No.: US 9,196,263 B2
(45) Date of Patent: Nov. 24, 2015

(54) PITCH PERIOD SEGMENTATION OF SPEECH SIGNALS

(75) Inventor: Harald Romsdorfer, Graz (AT)

(73) Assignee: Synvo Gmbh, Leoben (AT)

( * ) Notice: Subject to any disclaimer, the term of this patent is extended or adjusted under 35 U.S.C. 154(b) by 668 days.

(21) Appl. No.: 13/520,034

(22) PCT Filed: Dec. 29, 2010

(86) PCT No.: PCT/EP2010/070898
§ 371 (c)(1),
(2), (4) Date: Dec. 17, 2012

(87) PCT Pub. No.: WO2011/080312
PCT Pub. Date: Jul. 7, 2011

(65) Prior Publication Data

US 2013/0144612 A1 Jun. 6, 2013

(30) Foreign Application Priority Data

Dec. 30, 2009 (EP) ..... 09405233

(51) Int. Cl.
*G10L 21/00* (2013.01)
*G10L 25/90* (2013.01)

(52) U.S. Cl.
CPC ..... *G10L 25/90* (2013.01); *G10L 2025/906* (2013.01)

(58) Field of Classification Search
CPC ..... G10L 25/90
See application file for complete search history.

(56) References Cited

U.S. PATENT DOCUMENTS

| | | | | |
|---|---|---|---|---|
| 4,034,160 | A * | 7/1977 | Van Gerwen | 704/201 |
| 5,392,231 | A * | 2/1995 | Takahashi | 708/400 |
| 5,452,398 | A | 9/1995 | Yamada et al. | |
| 6,278,971 | B1 * | 8/2001 | Inoue et al. | 704/205 |
| 6,418,405 | B1 * | 7/2002 | Satyamurti et al. | 704/206 |

(Continued)

OTHER PUBLICATIONS

Brown, Judith C., and Miller S. Puckette. "A high resolution fundamental frequency determination based on phase changes of the Fourier transform." The Journal of the Acoustical Society of America 94.2 (1993): 662-667.*

(Continued)

*Primary Examiner* — Brian Albertalli
(74) *Attorney, Agent, or Firm* — Robert A. Blaha; Smith Risley Tempel Santos LLC

(57) ABSTRACT

A method for automatic segmentation of pitch periods of speech waveforms takes a speech waveform, a corresponding fundamental frequency contour of the speech waveform, that can be computed by some standard fundamental frequency detection algorithm, and optionally the voicing information of the speech waveform, that can be computed by some standard voicing detection algorithm, as inputs and calculates the corresponding pitch period boundaries of the speech waveform as outputs by iteratively •calculating the Fast Fourier Transform (FFT) of a speech segment having a length of approximately two periods, the period being calculated as the inverse of the mean fundamental frequency associated with these speech segments, •placing the pitch period boundary either at the position where the phase of the third FFT coefficient is −180 degrees, or at the position where the correlation coefficient of two speech segments shifted within the two period long analysis frame maximizes, or at a position calculated as a combination of both measures stated above, and repeatedly shifting the analysis frame one period length further until the end of the speech waveform is reached.

20 Claims, 5 Drawing Sheets

(56) References Cited

U.S. PATENT DOCUMENTS

| | | | | |
|---|---|---|---|---|
| 6,453,283 | B1 * | 9/2002 | Gigi | 704/207 |
| 6,587,816 | B1 * | 7/2003 | Chazan et al. | 704/207 |
| 6,885,986 | B1 * | 4/2005 | Gigi | 704/207 |
| 7,043,424 | B2 * | 5/2006 | Chen et al. | 704/207 |
| 7,092,881 | B1 * | 8/2006 | Aguilar et al. | 704/233 |
| H2172 | H * | 9/2006 | Staelin et al. | 704/207 |
| 8,010,350 | B2 * | 8/2011 | Zopf | 704/207 |
| 2004/0220801 | A1 * | 11/2004 | Sato | 704/207 |
| 2011/0015931 | A1 * | 1/2011 | Kawahara et al. | 704/264 |

OTHER PUBLICATIONS

De Cheveigne Alain et al., "YIN, a Fundamental Frequency Estimator for Speech and Music," The Journal of Acoustical Society of America, Apr. 1, 2002, pp. 1917-1930, vol. 111, No. 4, American Institute of Physics for the Acoustical Society of America, New York, NY, U.S.A.

Fujisaki et al., "Proposal and Evaluation of a New Scheme for Reliable Pitch Extraction of Speech," Proceedings of the International Conference on Spoken Language Processing, Nov. 18, 1990, pp. 473-476, vol. 1 of 2, Proceedings of the International Conference on Spoken Language, Tokyo, ASJ, Japan.

Gerhard, David, "Pitch Extraction and Fundamental Frequency: History and Current Techniques," Department of Computer Science, University of Regina, Nov. 2003, pp. 1-23, University of Regina, Regina, Saskatchewan, Canada.

Hosom, J.P., "Speaker Independent Phoneme Alignment Using Transition-Dependent States," Center for Spoken Language Understanding, School of Science & Engineering, Oregon Health & Science University, Nov. 3, 2008, pp. 1-29, Oregon Health and Science University, Beaverton, Oregon, U.S.A.

Ahmadi et al., "Cepstrum-Based Pitch Detection Using a New Statistical V/UV Classification Algorithm," IEEE Transactions on Speech and Audio Processing, May 1999, pp. 333-338, vol. 7, No. 3., IEEE.

Romsdorfer et al., "Phonteic Labeling and Segmentation of Mixed-Lingual Prosody Databases," Speech Processing Group Computer Engineering and Networks Laboratory, Sep. 4-8, 2005, pp. 3281-3284, Proceedings of Interspeech 2005, Lisbon, Portugal.

Romsdorfer, "Polygot Text-to-Speech Synthesis—Text Analysis & Prosody Control," PhD thesis, No. 18210, Computer Engineering and Networks Laboratory, ETH Zurich, Jan. 2009, pp. 1-232. ETH, Zurich, Switzerland.

* cited by examiner

PITCH PERIOD SEGMENTATION OF SPEECH SIGNALS

The present invention relates to speech analysis technology.

BACKGROUND ART

Speech is an acoustic signal produced by the human vocal apparatus. Physically, speech is a longitudinal sound pressure wave. A microphone converts the sound pressure wave into an electrical signal. The electrical signal can be converted from the analog domain to the digital domain by sampling at discrete time intervals. Such a digitized speech signal can be stored in digital format.

A central problem in digital speech processing is the segmentation of the sampled waveform of a speech utterance into units describing some specific form of content of the utterance. Such contents used in segmentation can be 1. Words
2. Phones
3. Phonetic features
4. Pitch periods Word segmentation aligns each separate word or a sequence of words of a sentence with the start and ending point of the word or the sequence in the speech waveform.

Phone segmentation aligns each phone of an utterance with the according start and ending point of the phone in the speech waveform. (H. Romsdorfer and B. Pfister. Phonetic labeling and segmentation of mixed-lingual prosody databases. *Proceedings of Interspeech* 2005, pages 3281-3284, Lisbon, Portugal, 2005) and (J.-P. Hosom. Speaker-independent phoneme alignment using transition-dependent states. *Speech Communication,* 2008) describe examples of such phone segmentation systems. These segmentation systems achieve phone segment boundary accuracies of about 1 ms for the majority of segments, cf. (H. Romsdorfer. Polyglot Text-to-Speech Synthesis. Text Analysis and Prosody Control. PhD thesis, No. 18210, Computer Engineering and Networks Laboratory, ETH Zurich (TIK-Schriftenreihe Nr. 101), January 2009) or (J.-P. Hosom. Speaker-independent phoneme alignment using transition-dependent states. *Speech Communication,* 2008).

Phonetic features describe certain phonetic properties of the speech signal, such as voicing information. The voicing information of a speech segment describes whether this segment was uttered with vibrating vocal chords (voiced segment) or without (unvoiced or voiceless segment). (S. Ahmadi and A. S. Spanias. Cepstrum-based pitch detection using a new statistical v/uv classification algorithm. *IEEE Transactions on Speech and Audio Processing,* 7(3), May 1999) describes an algorithm for voiced/unvoiced classification. The frequency of the vocal chord vibration is often termed the fundamental frequency or the pitch of the speech segment. Fundamental frequency detection algorithms are described in, e.g., (S. Ahmadi and A. S. Spanias. Cepstrum-based pitch detection using a new statistical v/uv classification algorithm. *IEEE Transactions on Speech and Audio Processing,* 7(3), May 1999) or in (A. de Cheveigne and H. Kawahara. YIN, a fundamental frequency estimator for speech and music. *Journal of the Acoustical Society of America,* 111(4):1917-1930, April 2002). In case nothing is uttered, the segment is referred to as being silent. Boundaries of phonetic feature segments do not necessarily coincide with phone segment boundaries. Phonetic segments may even span several phone segments, as shown in FIG. 1. Pitch period segmentation must be highly accurate, as the pitch period lengths $T_p$ can typically be between 2 ms and 20 ms. The pitch period is the inverse of the fundamental frequency $F_0$, cf. Eq. 1, that typically ranges for male voices between 50 and 180 Hz and for female voices between 100 and 500 Hz. FIG. 2 shows some pitch periods of a voiced speech segment having a fundamental frequency of approximately 200 Hz.

$$T_p = 1/F_0 \quad \text{(Eq. 1)}$$

Segmentation of speech waveforms can be done manually. However, this is very time consuming and the manual placement of segment boundaries is not consistent. Automatic segmentation of speech waveforms drastically improves segmentation speed and places segment boundaries consistently. This comes sometimes at the cost of decreased segmentation accuracy. While for word, phone, and several phonetic features automatic segmentation procedures do exist and provide the necessary accuracy, see for example (J.-P. Hosom. Speaker-independent phoneme alignment using transition-dependent states. *Speech Communication,* 2008) for very accurate phone segmentation, no automatic segmentation algorithm for pitch periods is known.

It is an object of the invention to enable segmentation of pitch periods of speech waveforms.

SUMMARY OF INVENTION

This object is solved by the subject-matter according to the independent claims. Further embodiments are shown by the dependent claims. All embodiments described for the method also hold for the device, and vice versa.

In the context of this application, the term "speech waveform" particularly denotes a representation that indicates how the amplitude in a speech signal varies over time. The amplitude in speech signal can represent diverse physical quantities, e.g., the variation in air pressure in front of the mouth.

The term "fundamental frequency contour" particularly denotes a sequence of fundamental frequency values for a given speech waveform that is interpolated within unvoiced segments of the speech waveform.

The term "voicing information" particularly denotes information indicative of whether a given segment of a speech waveform was uttered with vibrating vocal chords (voiced segment) or without vibrating vocal chords (unvoiced or voiceless segment).

An example for a fundamental frequency detection algorithm which can be applied by an embodiment of the invention is disclosed in "YIN, a fundamental frequency estimator for speech and music" (A. de Cheveigne and H. Kawahara: *Journal of the Acoustical Society of America,* 111(4):1917-1930, April 2002). This corresponding disclosure of the fundamental frequency detection algorithm is incorporated by reference in the disclosure of this patent application.

An example for a voicing detection algorithm which can be applied by an embodiment of the invention is disclosed in "Cepstrum-based pitch detection using a new statistical v/uv classification algorithm" (S. Ahmadi and A. S. Spanias: *IEEE Transactions on Speech and Audio Processing,* 7(3), May 1999). This corresponding disclosure of the voicing detection algorithm is incorporated by reference in the disclosure of this patent application.

An embodiment of the new and inventive method for automatic segmentation of pitch periods of speech waveforms takes the speech waveform, the corresponding fundamental frequency contour of the speech waveform, that can be computed by some standard fundamental frequency detection algorithm, and optionally the voicing information of the speech waveform, that can be computed by some standard voicing detection algorithm, as inputs and calculates the corresponding pitch period boundaries of the speech waveform as outputs by iteratively calculating the Fast Fourier Transform (FFT) of a speech segment having a length of (for instance approximately) two (or more) periods, $T_a+T_b$, a period being calculated as the inverse of the mean fundamental frequency associated with these speech segments, placing the pitch period boundary either at the position where the phase of the third FFT coefficient is −180 degrees (for analysis frames having a length of two periods), or at the position where the correlation coefficient of two speech segments shifted within the two period long analysis frame is maximal (or maximizes), or at a position calculated as a combination of both measures stated above, and shifting the analysis frame one period length further, and repeating the preceding steps until the end of the speech waveform is reached.

Thus, in other words, a periodicity measure can be computed firstly by means of an FFT, the periodicity measure being a position in time, i.e. along the signal, at which a predetermined FFT coefficient takes on a predetermined value.

Secondly, instead of calculating the FFT, the correlation coefficient of two speech sub-segments shifted relative to one another and separated by a period boundary within the two period long analysis frame is used as a periodicity measure, and the pitch period boundary is set such that this periodicity measure is maximal.

In an embodiment, a method for automatic segmentation of pitch periods of speech waveforms is provided, the method taking a speech waveform and a corresponding fundamental frequency contour of the speech waveform as inputs and calculating the corresponding pitch period boundaries of the speech waveform as outputs by iteratively performing the steps of

- choosing an analysis frame, the frame comprising a speech segment having a length of n periods with n being larger than 1, a period being calculated as the inverse of the mean fundamental frequency associated with this speech segment, and then
  - either calculating the Fast Fourier Transform (FFT) of the speech segment and placing the pitch period boundary at the position where the phase of the (n+1) th FFT coefficient takes on a predetermined value, e.g., −180 degrees for n=2 and n 32 3, and 0 degrees for n=4;
  - or calculating a correlation coefficient of two speech sub-segments shifted relative to one another and separated by a period boundary within the analysis frame, and setting the pitch period boundary such that this correlation coefficient is maximal;
  - or at a position calculated as a combination of the two positions calculated in the manner described above, and shifting the analysis frame one period length further and repeating the preceding steps until the end of the speech waveform is reached.

According to yet another exemplary embodiment of the invention, a computer-readable medium (for instance a CD, a DVD, a USB stick, a floppy disk or a harddisk) is provided, in which a computer program is stored which, when being executed by a processor (such as a microprocessor or a CPU), is adapted to control or carry out a method having the above mentioned features.

Speech data processing which may be performed according to embodiments of the invention can be realized by a computer program, that is by software, or by using one or more special electronic optimization circuits, that is in hardware, or in hybrid form, that is by means of software components and hardware components.

DETAILED DESCRIPTION OF PREFERRED EMBODIMENTS

Figure 1:
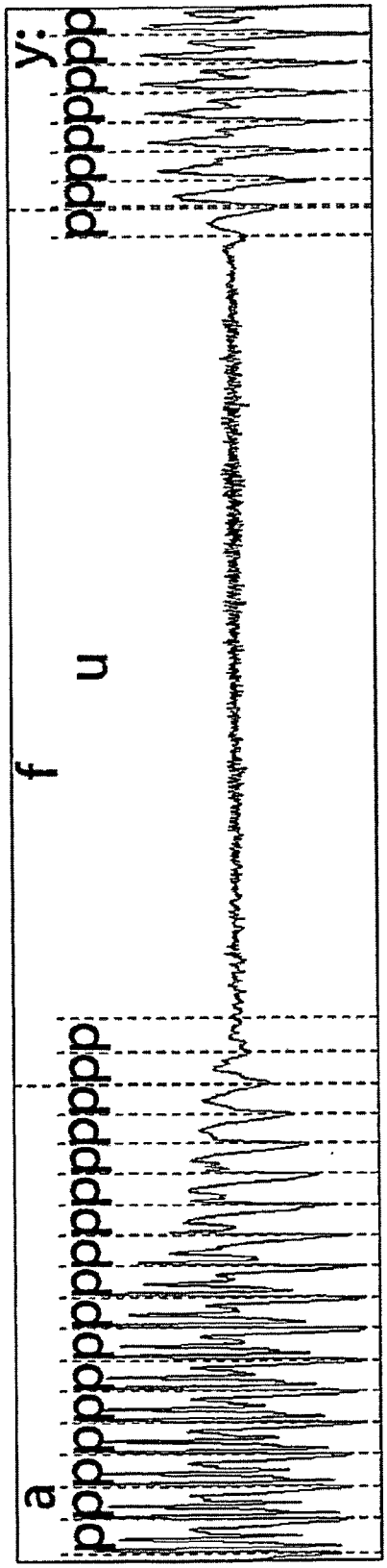
FIG. 1 shows the segmentation of phone segments [a,f,y:] and of pitch period segments (denoted with 'p').
Figure 2:
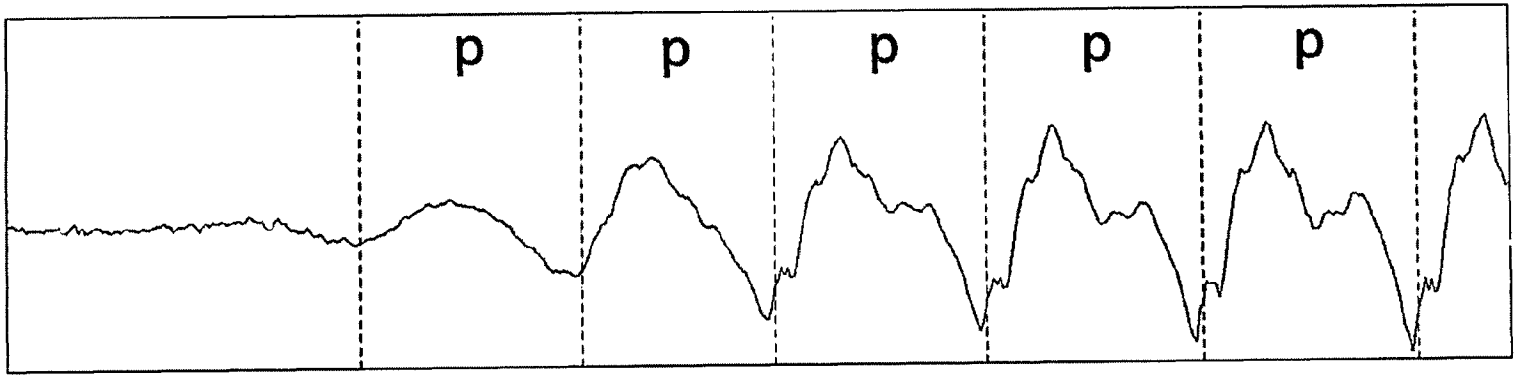
FIG. 2 illustrates pitch periods of a voiced speech segment with a fundamental frequency of about 200 Hz.

Given a speech segment, such as the one of FIG. 1, the fundamental frequency is determined, e.g. by one of the initially referenced known algorithms. The fundamental frequency changes over time, corresponding to a fundamental frequency contour (not shown in the figures). Furthermore, the voicing information may be determined.

Figure 3:
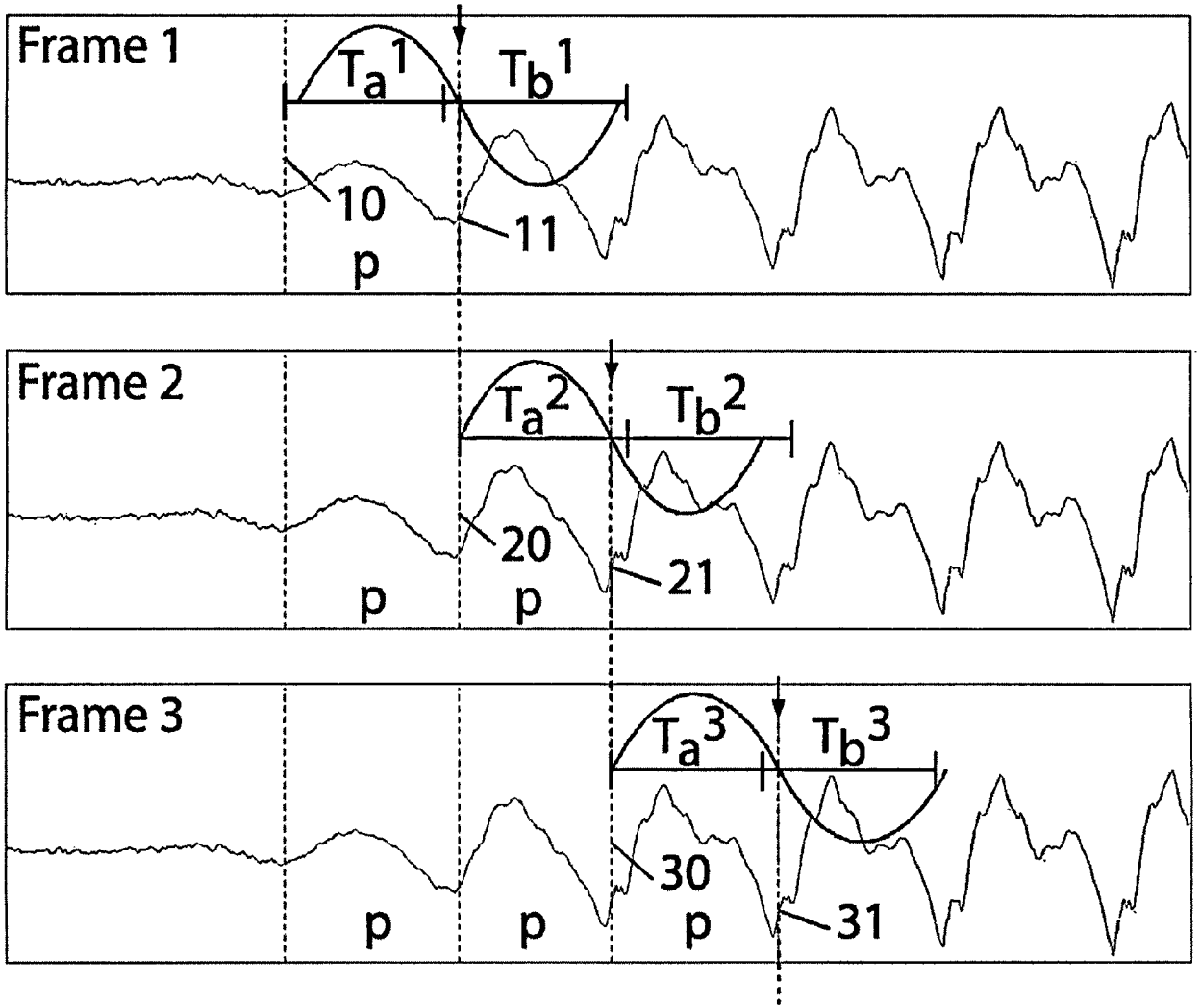
FIG. 3 illustrates the iterative algorithm of automatic pitch period boundary placement according to an exemplary embodiment of the invention.

1. Given the fundamental frequency contour and the voicing information of the speech waveform, further analysis starts with an analysis frame of approximately two period length, $T_a^1+T_b^1$ (cf. FIG. 3), starting at the beginning of the first voiced segment (10 in FIG. 3). The lengths $T_a^1$ and $T_b^1$ are calculated as the inverse of the mean fundamental frequency associated with these speech segments.

2. Then the Fast Fourier Transform (FFT) of the speech waveform within the current analysis frame is computed.

3. The pitch period boundary between the periods $T_a^1$ and $T_b^1$ is then placed at the position (11 in FIG. 3) where the phase of the third FFT coefficient is −180 degrees, or at the position where the correlation coefficient of two speech segments shifted within the two period long analysis frame is maximal, or at a position calculated as a weighted combination (for instance equally weighted) of these two measures.

4. The calculated pitch period boundary (11 in FIG. 3) is the new starting point (20 in FIG. 3) for the next analysis frame of approximately two period length, $T_a^2+T_b^2$, being freshly calculated as the inverse of the mean fundamental frequency associated with the shifted speech segments.

5. For calculating the following pitch period boundaries, e.g. 21 and 31 in FIG. 3, steps 2 to 4 are repeated until the end of the voiced segment is reached.

6. After reaching the end of a voiced segment, analysis is continued at the next voiced segment with step 1 until reaching the end of the speech waveform.

Figure 4:
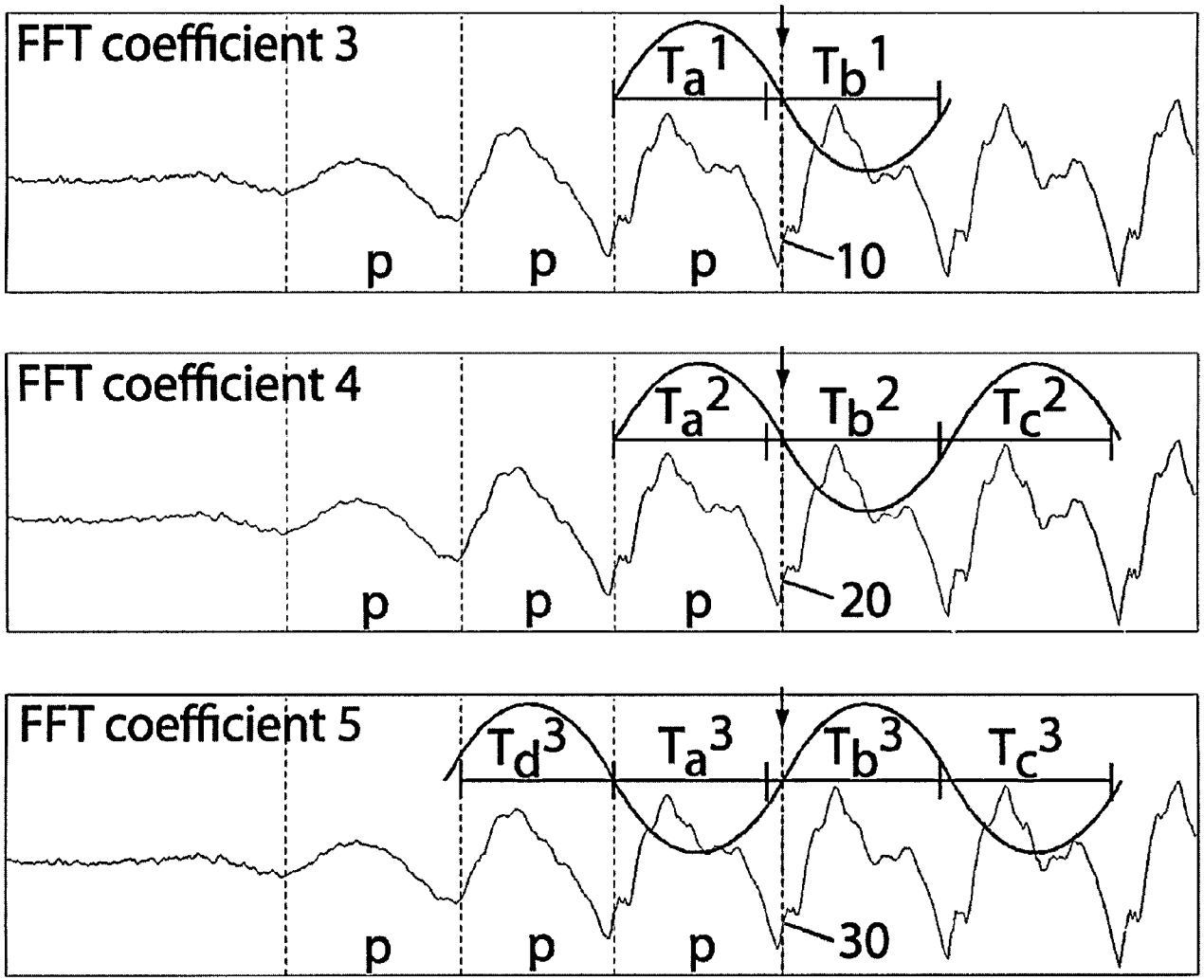
FIG. 4 shows the placement of the pitch period boundary using the phase of the third (10), of the fourth (20), or of the fifth (30) FFT coefficient.

In case more than two periods are used in FFT analysis, the pitch period boundary is placed, in case of an approximately three period long analysis frame, at the position where the phase of the fourth FFT coefficient (20 in FIG. 4) is −180 degrees, or, in case of a approximately four period long analysis frame, at the position where the phase of the fifth FFT coefficient (30 in FIG. 4) is 0 degree. Higher order FFT coefficients are treated accordingly.

Figure 5:
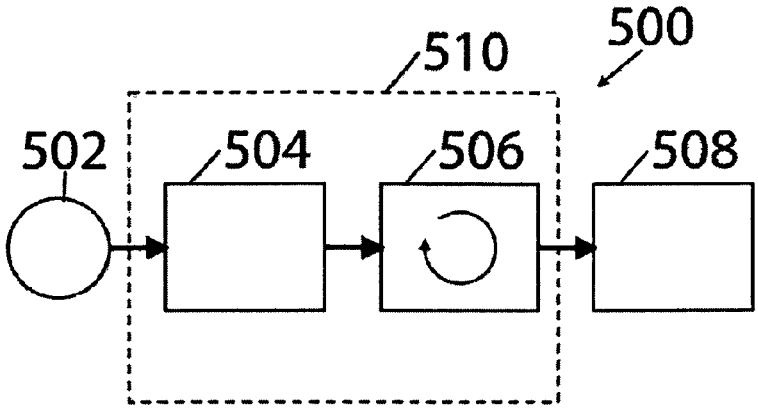
FIG. 5 illustrates a device for automatic segmentation of pitch periods of speech waveforms according to an exemplary embodiment of the invention.

FIG. 5 illustrates a device 500 for automatic segmentation of pitch periods of speech waveforms according to an exemplary embodiment of the invention.

The device 500 comprises a speech data source 502 and an input unit 504 supplied with speech data from the speech data source 502. The input unit 504 is configured for taking a speech waveform and a corresponding fundamental frequency contour of the speech waveform as inputs.

A calculating unit 506 is configured for calculating the corresponding pitch period boundaries of the speech waveform as outputs by iteratively choosing an analysis frame, the frame comprising a speech segment having a length of n periods (n being an integer) with n being larger than 1, a period being calculated as the inverse of the mean fundamental frequency associated with this speech segment, and then calculating the Fast Fourier Transform (FFT) of the speech segment and placing the pitch period boundary at the position where the phase of the (n+1)th FFT coefficient takes on a predetermined value, e.g., −180 degrees for n=2 and n=3, and 0 degrees for n=4;

or calculating a correlation coefficient of two speech sub-segments shifted relative to one another and separated by a period boundary within the analysis frame, and setting the pitch period boundary such that this correlation coefficient is maximal;

or at a position calculated as a combination of the two positions calculated according to the two alternatives described above, and shifting the analysis frame one period length further and repeating the preceding calculating step(s) until the end of the speech waveform is reached.

The result of this calculation can be supplied to a destination 508 such as a storage device for storing the calculated data or for further processing the data. The input unit 504 and the calculating unit 506 can be realized as a common processor 510 or as separate processors.

Figure 6:
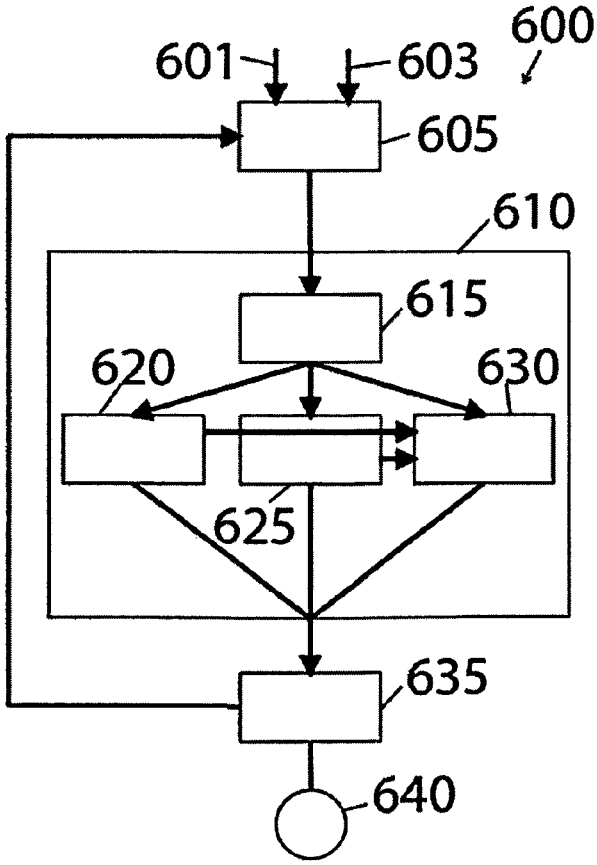
FIG. 6 is a flow chart which illustrates a method of automatic segmentation of pitch periods of speech waveforms according to an exemplary embodiment of the invention.

FIG. 6 illustrates a flow diagram 600 being indicative of a method of automatic segmentation of pitch periods of speech waveforms according to an exemplary embodiment of the invention.

In a block 605, the method takes a speech waveform (as a first input 601) and a corresponding fundamental frequency contour (as a second input 603) of the speech waveform as inputs.

In a block 610, the method calculates the corresponding pitch period boundaries of the speech waveform as outputs. This includes iteratively performing the steps of choosing an analysis frame, the frame comprising a speech segment having a length of n periods with n being larger than 1, a period being calculated as the inverse of the mean fundamental frequency associated with this speech segment (block 615), and then either calculating the Fast Fourier Transform (FFT) of the speech segment and placing the pitch period boundary at the position where the phase of the (n+1) th FFT coefficient takes on a predetermined value, e.g., −180 degrees for n=2 and n=3, and 0 degrees for n=4 (block 620);

or calculating a correlation coefficient of two speech sub-segments shifted relative to one another and separated by a period boundary within the analysis frame, and setting the pitch period boundary such that this correlation coefficient is maximal (block 625);

or at a position calculated as a combination of the two positions calculated in the manner described above (block 630).

In a block 635, the method shifts the analysis frame one period length further. The method then repeats the preceding steps until the end of the speech waveform is reached (reference numeral 640).

It should be noted that the term "comprising" does not exclude other elements or steps and the "a" or "an" does not exclude a plurality. Also elements described in association with different embodiments may be combined.

It should also be noted that reference signs in the claims shall not be construed as limiting the scope of the claims.

Implementation of the invention is not limited to the preferred embodiments shown in the figures and described above. Instead, a multiplicity of variants are possible which use the solutions shown and the principle according to the invention even in the case of fundamentally different embodiments.

References Cited in the Description

S. Ahmadi and A. S. Spanias. Cepstrum-based pitch detection using a new statistical v/uv classification algorithm. *IEEE Transactions on Speech and Audio Processing,* 7(3), May 1999

A. de Cheveigne and H. Kawahara. YIN, a fundamental frequency estimator for speech and music. *Journal of the Acoustical Society of America,* 111(4):1917-1930, April 2002

J.-P. Hosom. Speaker-independent phoneme alignment using transition-dependent states. *Speech Communication,* 2008

H. Romsdorfer. Polyglot Text-to-Speech Synthesis. Text Analysis and Prosody Control. *PhD thesis, No.* 18210, Computer Engineering and Networks Laboratory, ETH Zurich (TIK-Schriftenreihe Nr. 101), January 2009

H. Romsdorfer and B. Pfister. Phonetic labeling and segmentation of mixed-lingual prosody databases. *Proceedings of Interspeech* 2005, pages 3281-3284, Lisbon, Portugal, 2005

The invention claimed is:

1. A method for automatic segmentation of pitch periods of speech waveforms, the method comprising:

taking the speech waveform and the corresponding fundamental frequency contour of the speech waveform as inputs; and calculating the corresponding pitch period boundaries of the speech waveform as outputs by iteratively calculating the Fast Fourier Transform (FFT) of a speech segment of approximately two period length, calculated as the inverse of the mean fundamental frequency associated with these speech segments, placing the pitch period boundary at the position where the phase of the third FFT coefficient is −180 degrees, and shifting the analysis frame one period length further until the end of the speech waveform is reached.

2. Method as claimed in claim 1, wherein the method comprises computing corresponding fundamental frequency contour of the speech waveform by a fundamental frequency detection algorithm.

3. Method as claimed in claim 1, wherein the method comprises computing voicing information of the speech waveform by a voicing detection algorithm.

4. Method as claimed in claim 1, wherein the method comprises computing, in combination with calculating the FFT, the correlation coefficient of two speech sub-segments shifted relative to one another and separated by a period boundary within the two period long analysis frame as a periodicity measure, and setting the pitch period boundary at a weighted mean position of these two periodicity measures.

5. Method as claimed in claim 4, wherein the method comprises setting the pitch period boundary at the mean position of these two periodicity measures.

6. A device for automatic segmentation of pitch periods of speech waveforms, the device comprising:

an input unit configured for taking a speech waveform and a corresponding fundamental frequency contour of the speech waveform as inputs, and a calculating unit configured for calculating the corresponding pitch period boundaries of the speech waveform as outputs by iteratively choosing an analysis frame, the frame comprising a speech segment having a length of n periods with n being larger than 1, a period being calculated as the inverse of the mean fundamental frequency associated with this speech segment, and then either calculating the Fast Fourier Transform (FFT) of the speech segment and placing the pitch period boundary at the position where the phase of the $(n+1)^{th}$ FFT coefficient takes on a predetermined value; or calculating a correlation coefficient of two speech sub-segments shifted relative to one another and separated by a period boundary within the analysis frame, and setting the pitch period boundary such that this correlation coefficient is maximal; or at a position calculated as a combination of the two positions calculated in the manner described above, and shifting the analysis frame one period length further and repeating the preceding steps until the end of the speech waveform is reached.

7. Device as claimed in claim 6, wherein the input unit is configured for using voicing information corresponding to the speech waveform, computed by a voicing detection algorithm as additional input in such a way that only within voiced segments of the speech waveform the corresponding pitch period boundaries of the speech waveform are calculated as claimed in claim 6.

8. Device as claimed in claim 6, wherein an analysis frame comprising a speech segment having a length of 2 periods is used and the pitch period boundary is placed at the position where the phase of the third FFT coefficient takes on a value of −180 degrees.

9. Device as claimed in claim 6, wherein an analysis frame comprising a speech segment having a length of 3 periods is used and the pitch period boundary is placed at the position where the phase of the $4^{th}$ FFT coefficient takes on a value of −180 degrees.

10. Device as claimed in claim 6, wherein an analysis frame comprising a speech segment having a length of 4 periods is used and the pitch period boundary is placed at the position where the phase of the $5^{th}$ FFT coefficient takes on a value of 0 degrees.

11. Device as claimed in claims 6, wherein the pitch period boundary is set at a position calculated as a weighted mean of a combination of positions.

12. Device as claimed in claim 11, wherein the pitch period boundary is set at a position calculated as mean of the position where the phase of the third FFT coefficient takes on a value of −180 degrees and a position determined by the correlation coefficient of two speech sub-segments shifted relative to one another and separated by a period boundary within this analysis frame, wherein the pitch period boundary is set such that this correlation coefficient is maximal.

13. The device of claim 6, wherein the input configured for taking the speech waveform is responsive to a voicing detection algorithm having identified that speech is present.

14. The device of claim 6, wherein the calculating unit is responsive to a voicing detection algorithm having identified that speech is present.

15. The device of claim 6, wherein the predetermined value is 0 degrees.

16. The device of claim 6, wherein the predetermined value is −180 degrees.

17. A non-transitory computer-readable medium, in which a computer program is stored, which computer program, when being executed by a processor performs a method comprising:

receiving a speech waveform;

receiving a corresponding fundamental frequency contour of the speech waveform;

calculating pitch period boundaries of the speech waveform by iteratively choosing an analysis frame, the frame comprising a speech segment of approximately n periods, where n is an integer greater than 1, a period calculated as the inverse of the mean fundamental frequency associated with the speech segment;

placing the pitch period boundary at a position identified by one of:

calculating a Fast Fourier Transform (FFT) of the speech segment and identifying the position where the phase of the $(n+1)^{th}$ FFT coefficient takes on a predetermined value; or calculating a correlation coefficient of two speech sub-segments shifted relative to one another and separated by a period boundary within the analysis frame and identifying the position such that the correlation coefficient is at a maximum; or calculating a position as a combination of the two positions calculated in the manner described above; and shifting the analysis frame one period length further until the end of the speech waveform is reached.

18. The non-transitory computer-readable medium of claim 17, wherein receiving the speech waveform is responsive to a voicing detection algorithm having identified that speech is present.

19. The non-transitory computer-readable medium of claim 17, wherein calculating pitch period boundaries is responsive to a voicing detection algorithm having identified that speech is present.

20. The non-transitory computer-readable medium of claim 17, wherein the predetermined value is one of 0 degrees or −180 degrees.

* * * * *